United States Patent [19]

Clive-Smith

[11] Patent Number: 4,593,831

[45] Date of Patent: Jun. 10, 1986

[54] CONTAINERS

[76] Inventor: Martin Clive-Smith, 151 Broomwood Road, London SW11 6JV, England

[21] Appl. No.: 675,465

[22] Filed: Nov. 28, 1984

Related U.S. Application Data

[63] Continuation of Ser. No. 441,104, Nov. 12, 1982.

[30] Foreign Application Priority Data

Nov. 13, 1981 [GB] United Kingdom ..... 8134212
May 20, 1982 [GB] United Kingdom ..... 8214709

[51] Int. Cl.[4] ..... F16B 5/00
[52] U.S. Cl. ..... 220/1.5; 220/80
[58] Field of Search ..... 220/1.5, 80, 76

[56] References Cited

U.S. PATENT DOCUMENTS

| | | | |
|---|---|---|---|
| 2,126,950 | 8/1938 | Ditchfield | 220/1.5 |
| 3,027,025 | 3/1962 | Tantlinger | 214/38 |
| 3,044,656 | 7/1962 | Combs et al. | 220/1.5 |
| 3,061,133 | 10/1962 | Reynolds | 220/1.5 |
| 3,128,897 | 4/1964 | Wilkins | 220/1.5 |
| 3,716,259 | 2/1973 | Weill et al. | 220/80 X |
| 3,799,383 | 3/1974 | Gerhard | 220/1.5 |
| 3,989,157 | 11/1976 | Veenema | 220/80 X |
| 4,271,975 | 6/1981 | Ketner et al. | 220/1.5 X |
| 4,325,488 | 4/1982 | Ketner | 220/80 X |

FOREIGN PATENT DOCUMENTS

| | | |
|---|---|---|
| 1384369 | 2/1975 | United Kingdom . |
| 2065604A | 7/1981 | United Kingdom . |

*Primary Examiner*—Steven M. Pollard
*Attorney, Agent, or Firm*—Banner, Birch, McKie & Beckett

[57] ABSTRACT

A cuboid container comprising elongate frame members (3 to 7 and 16) defining the edges of the container, panels (14, 15), doors, floors or the like defining the faces of the container, and a respective corner member (20 in FIG. 3) at each corner of the container, substantially all of each end of each frame member (e.g. 4 in FIG. 3) being within the periphery of and abutting a respective face of a corner member (20).

Many different configurations of corner members in accordance with the invention are disclosed.

12 Claims, 24 Drawing Figures

CONTAINERS

This application is a continuation of application Ser. No. 441,104 filed Nov. 12, 1982.

BACKGROUND OF THE INVENTION

THIS INVENTION relates to containers. So-called "intermodal" freight containers are commonly used for the transport of goods carried by rail waggons, road trailers, sea going vessels and the like. In order that these containers can be handled, stacked one upon another and lashed in position, their dimensions and strength are standardised, and at their corners they normally have standardised corner fittings. Typical of the type of corner fitting and container are those described in U.S. Pat. No. 3,027,025 of Mar. 27, 1962, and others as recommended by the International Organisation for Standardisation.

Whilst the known corner fittings satisfy the requirements of the users of the containers, and enable many types of handling and securing equipment to be devised and standardised for use with the containers, the usual shape of the corner fittings does not always facilitate the efficient manufacture of containers.

The corner fittings are usually of a rectangular box shape to which structural frame members are attached. The known frame members are larger in section than the mating face of the corner fitting, so that it is necessary to notch out the frame member to fit neatly to the corner fitting. Since the frame members can meet at the corner fitting from three perpendicular directions, and must also link soundly to one another, the resulting junction and the notching needed can be complex and expensive to perform.

Another disadvantage of known corner fittings is that they tend to limit the access to the interior of a container where doors and a door frame are provided. The interior of a dry freight container can be larger than the door aperture simply because the overall size and shape of the corner fitting does not suit the frame members that are attached to it to form the door aperture.

SUMMARY OF THE INVENTION

Accordingly, the present invention provides a cuboid container comprising elongate frame members defining the edges of the container, panels defining the faces of the container and a respective corner member at each corner of the container, substantially all of each end of each frame member being within the periphery of and abutting a respective face of a corner member.

Preferably, the corner members (also referred to herein as "corner fittings") comply with the standardised dimensional requirements. It has been found that a container in accordance with the invention can provide an improvement in the access to the container interior.

BRIEF DESCRIPTION OF THE DRAWINGS

So that the present invention may be more readily understood and so that further features may be appreciated, known containers and containers in accordance with the invention will now be described by way of example and with reference to the accompanying drawings in which.

DETAILED DESCRIPTION OF PREFERRED EMBODIMENTS

Figure 1:
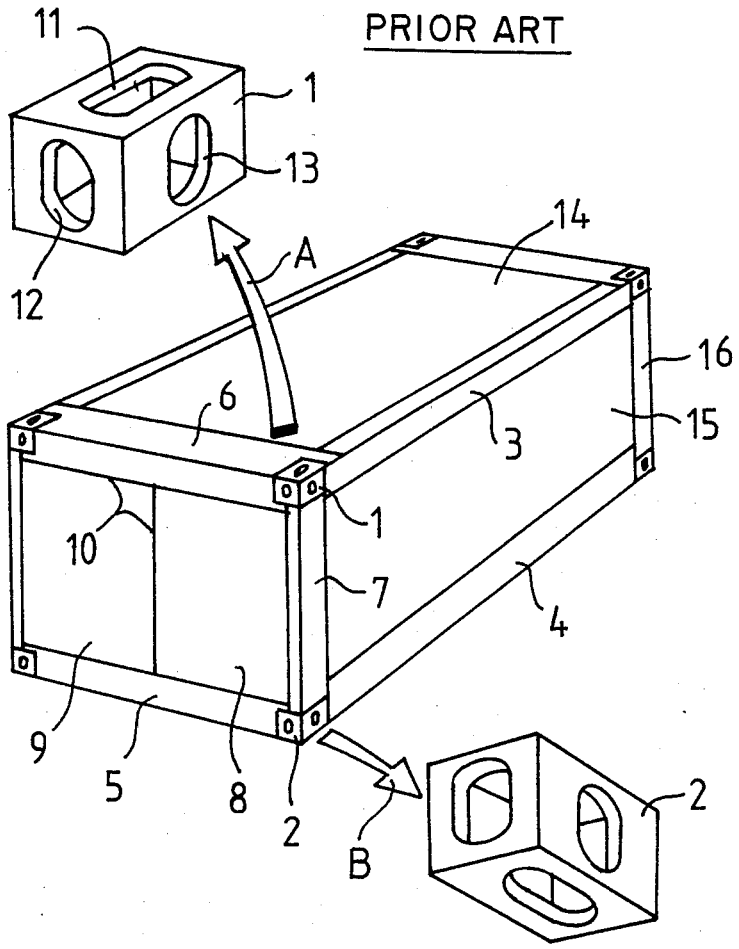
FIG.1 PRIOR ART
FIG. 1 is a perspective view of a known freight container with respective enlargements of a top and a bottom corner fitting.

FIG. 1 illustrates a typical freight container having respective fittings 1, 2 at each corner. Frame members 3, 4, 5, 6, 7, 16 are rigidly attached to the corner fittings 1, 2 and to each other where contact is made. At one end of the container there are two doors 8, 9. A flexible seal 10 is attached to the doors 8, 9 and runs around their perimeters, making contact with the frame members 5, 6, 7 defining the said end of the container. The corner fittings 1, 2 are also shown in FIG. 1 in enlarged form as indicated by arrows A and B. Typically, a corner fitting is made from cast metal in one piece, in the form of a cuboid hollow box, having respective apertures 11, 12, 13 formed in the three outwardly-facing faces. The apertures are of standardised sizes to suit standard handling and securing equipment. Between the frame members 3, 4, 5, 6, 7, are structural walls 15 and 14 to protect the goods stowed inside the container.

Figure 2:
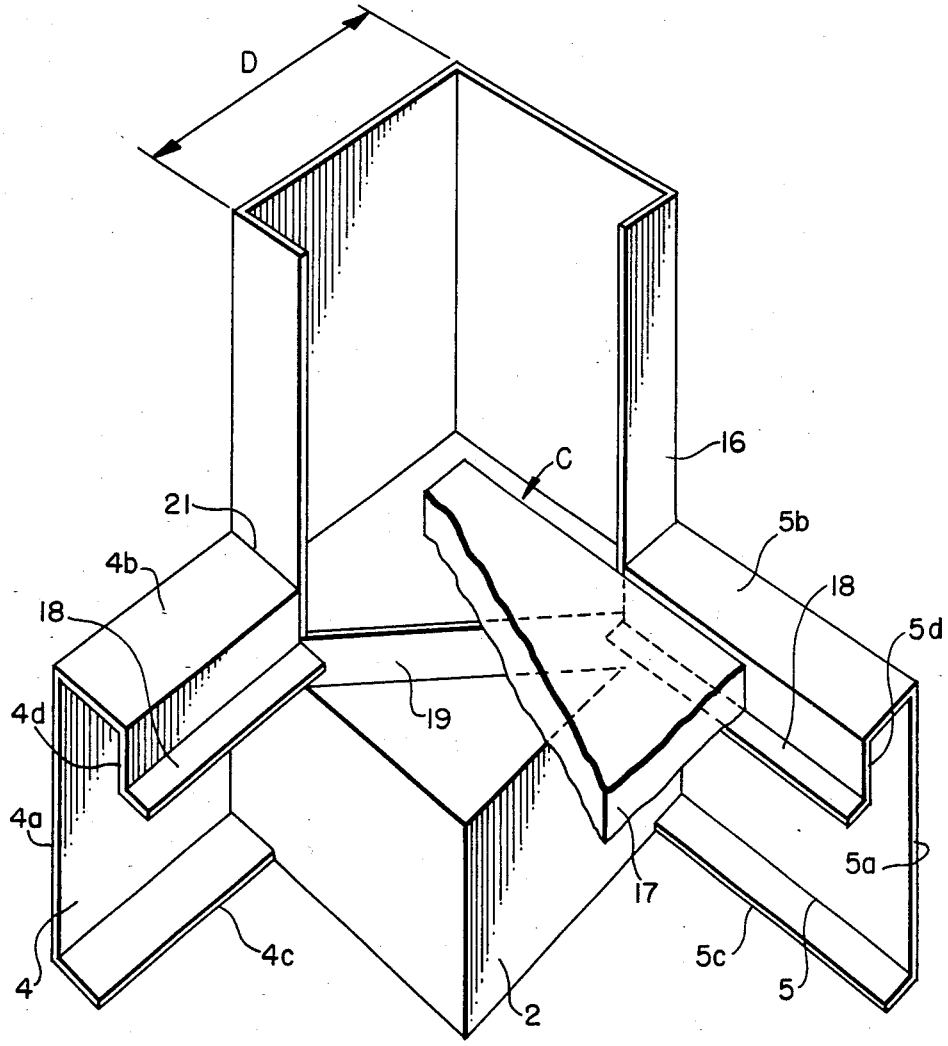
FIG. 2 is a perspective view from the inside of a known bottom corner fitting such as is shown in FIG. 1 with parts of frame members attached to it.

FIG. 2 shows a typical bottom corner fitting 2 seen from inside the container. The apertures 11, 12, 13 can not be seen since they are on the outer faces. The adjacent parts of three frame members 5, 4, 16 are shown as they attach to the corner fitting 2. It can be seen that each horizontal frame member 4, 5 comprises an upright web *4a, 5a*, top *4b, 5b* and bottom *4c, 5c* inwardly-extending horizontal flanges and an L-shaped stepped flange *4d, 5d* depending from the edge of the top flange *4b, 5b* remote from the upright web *4a, 5a*. The long arm of the "L" is upright and the short arm forms a horizontal inwardly-extending lip 18. A part of the flooring 17 of the container, typically of timber, is shown in position supported at least partly by the lip 18 of the frame members 4, 5.

Figure 3:
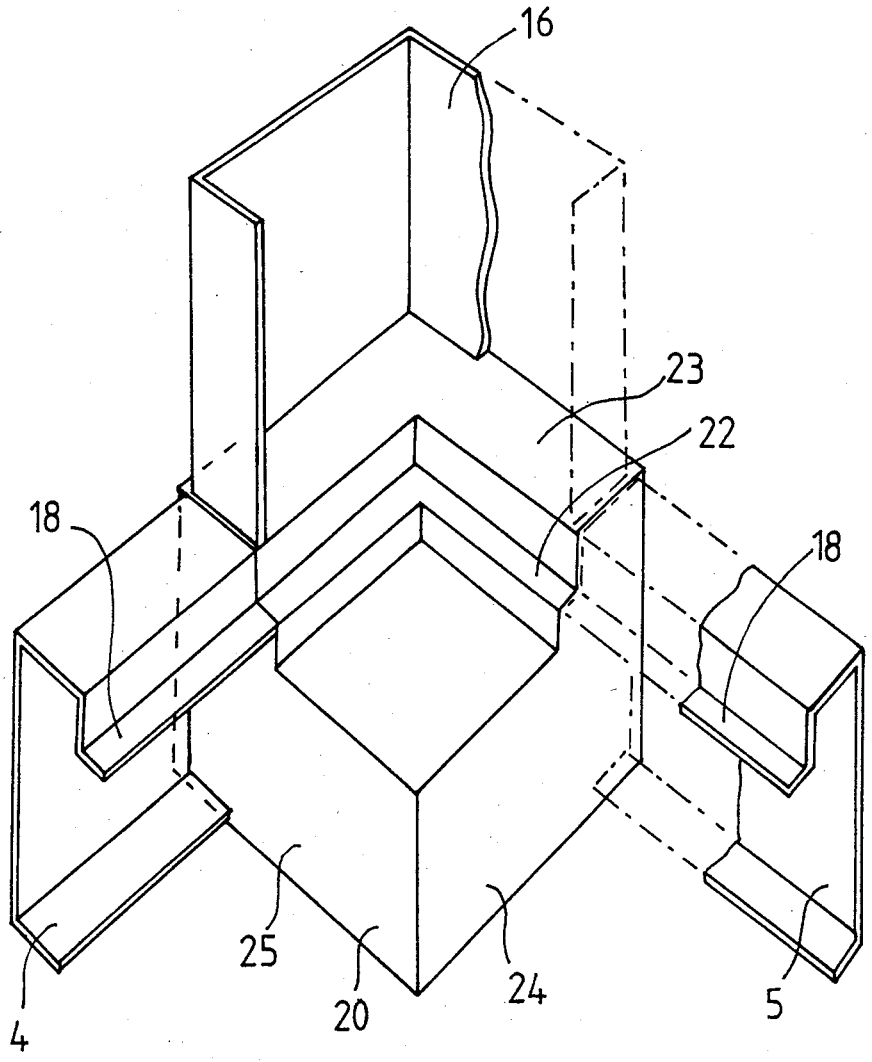
FIG. 3 is a perspective view of a bottom corner fitting in accordance with the invention showing parts of frame members attached to the corner fitting.

FIG. 3 corresponds to FIG. 2 but shows a corner fitting 20 in accordance with the invention, to which are attached the frame members 4, 5, 16. Adjacent parts of two frame members 5, 16 have been omitted to aid clarity.

Referring now to FIGS. 2 and 3, one preferred embodiment of the invention will be described.

In assembly of the known container, the frame members 4, 5, 16 are brought into abutment with the corner fitting 2 and with each other as shown. Typically, the components are welded together. A floor support component 19 is also fastened in place to support the corner of the floor timber 17. The floor timber 17 is, as stated, also supported on the lips 18 of the horizontal frame members 4, 5, and the support surfaces of the lips 18 and the support component 19 are therefore on the same plane. Because of the shape of the vertical frame member 16, there is a gap between the timber 17 and the vertical member 16 as indicated by arrow C. To prevent dirt and infestation in the container, the gap C must be filled and sealed to the floor timber 17 and to the upright frame member 16. It can be seen that the two horizontal frame members 4, 5 are welded to the upright frame member 16, for example at line 21, rather than to the stronger corner fitting 2. This is necessary because the said two frame members extend higher than the corner fitting 2. In manufacturing, the dimensions of the frame members, such as dimension D of the upright member 16, can vary. If the dimension D is too small, the junction at line 21 would open up making the joint weaker.

In FIG. 3, a single corner fitting 20 is provided so that all three frame members 4, 5, 16 connect directly to it, to provide a sturdy junction free of variation of frame-forming tolerances. The corner fitting 20 has a ledge 22 formed into it to continue the level of the floor timber support lips 18, and thus the extra component 19 may be omitted. A further raised portion 23 provides a surface which is closely flush with the top face of the floor timber 17 (not shown in FIG. 3), so that no additional filling of gaps in the structure is necessary. The ends of each frame member are cut off square where they meet the respective planar surfaces 23, 24, 25 of the corner fitting 20.

Figure 4:
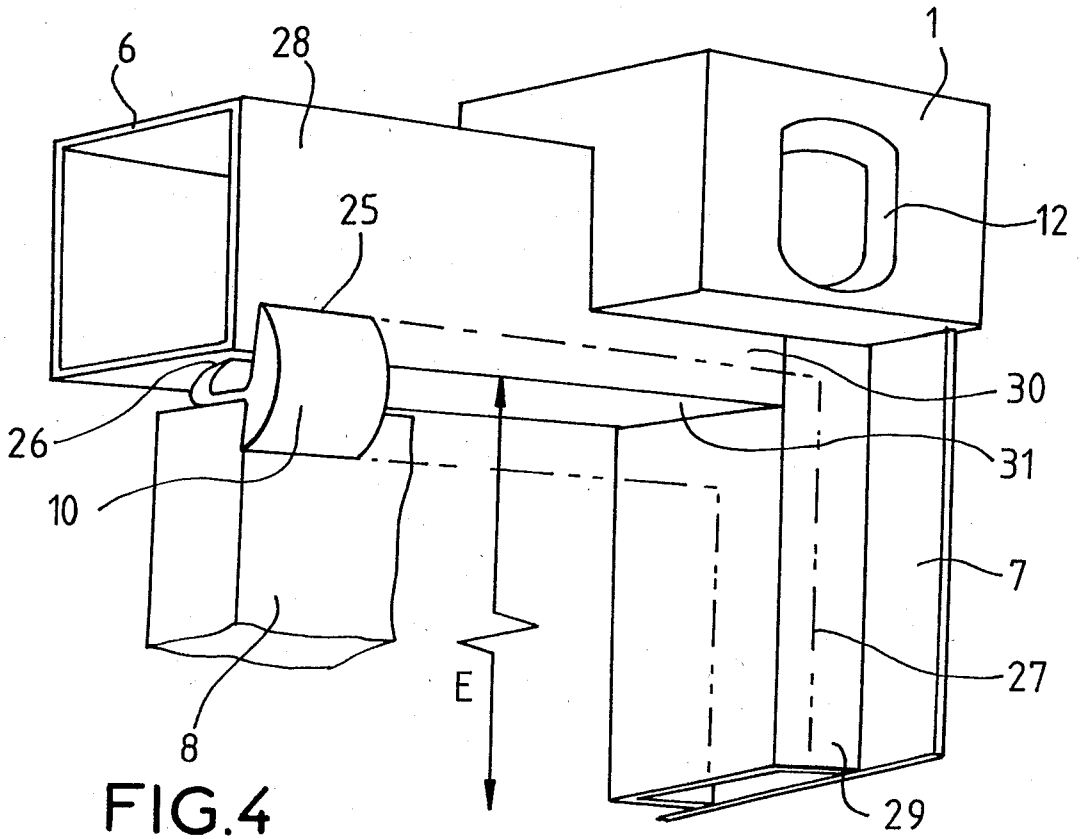
FIG. 4 PRIOR ART
FIG. 4 is a perspective view of a known corner fitting suitable for use at the door end of a container, viewed from outside the container.

FIG. 4 shows a known door end corner fitting 1. As illustrated, the fitting is a top fitting, but would also be suitable for use at the bottom. The fitting 1 is connected to a horizontal frame member 6 and to an upright frame member 7. A part of one door 8, and a small section of a flexible seal 10 engaged with the door are also shown. It can be seen that the seal is formed as a "J", comprising an outer portion 25 and an inner portion 26. The outer portion 25 laps over the door 8 and the adjacent frame member 6 or 7, and the inner portion 26 is pushed into the gap between the door 8 and the adjacent frame member 6 or 7. The seal is typically continuous around the door perimeter and the contact line of the outer lip 25 is denoted by a dotted line 27. To provide a smooth flat surface for the outer seal lip 25, the respective outer faces 28, 29 of the frame members 6 and 7 are within the same plane, this plane being inside the plane of the corresponding outer face of the corner mounting 1. Therefore, to provide a continuous surface for the seal under and around the corner fitting 1, the horizontal member 6 has to be formed with a projecting portion 30 which extends under the corner fitting 1. The said frame member 6 not only has to be cut away to form the projecting portion 30 but also is welded to the (usually less than robust) frame member 7 at line 31 rather than to the corner fitting alone. Similarly, the upright frame member 7 may have restricted weld access to the corner fitting 1 due to the presence of the horizontal frame member 6.

Figure 5:
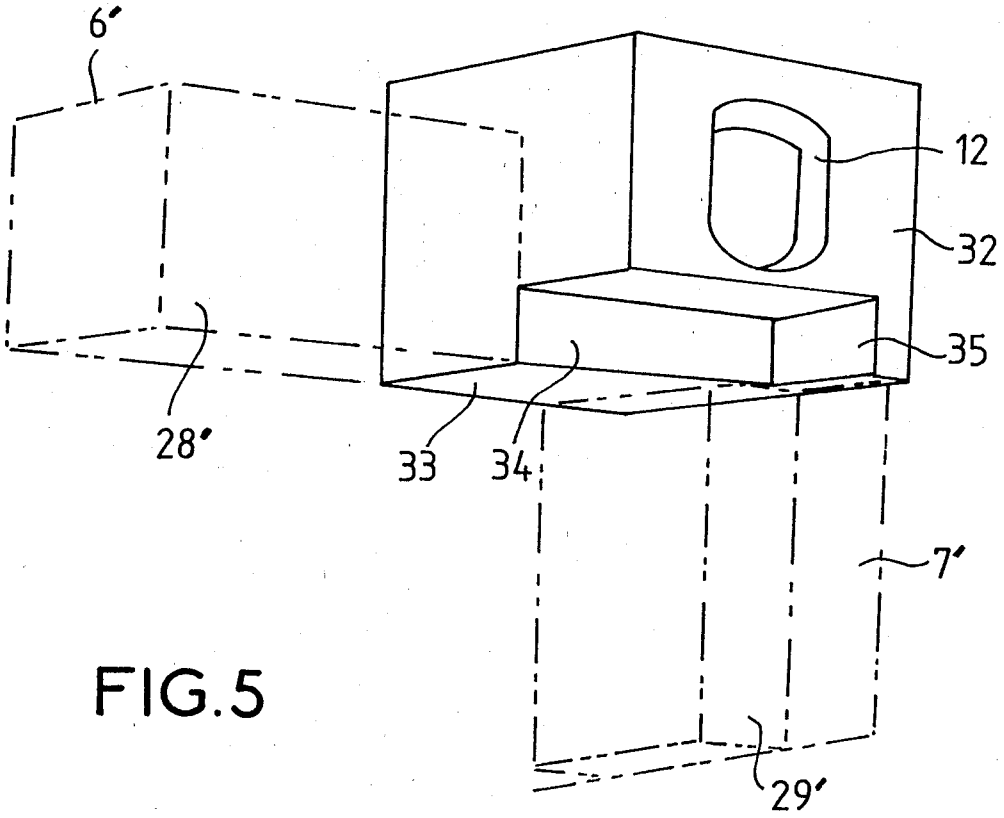
FIG. 5 corresponds to FIG. 4 but shows a corner fitting in accordance with the invention.

FIG. 5 shows an alternative corner fitting 32 in accordance with the invention. The position of the modified frame members 6' and 7' are shown in dash dotted line form. The corner fitting 32 is provided with a rebate to a first downwardly-extending part 33 having an outwardly-facing face 34 and a second downwardly extending portion 35.

Referring to FIGS. 4 and 5 a preferred embodiment of the invention will be described.

The complexities of forming the projecting portion 30 on the known frame member 6 in FIG. 4 are made greater by the fact that a typical horizontal member 6 is of box section, i.e. a hollow rectangular tube. Often, this has to be cut away by hand since no common machine exists for cutting a tube away in this manner in one movement. The result is often an untidy cut, forming large gaps between the contact edge of the protruding portion 30 and the corner fitting 1. Variations in the dimensions of the projecting portion 30 will displace the member 7 or cause assembly gaps at line 31 and resultant weakness.

The modified fitting 32 in FIG. 5 overcomes these problems by extending the corner fitting at 33 and 35, so that the frame members 6', 7' have planar surfaces to which they can be attached directly, without need of notching or projecting portions on the frame members themselves. Furthermore, continutiy of the sealing surface 28, 29 is provided by the outer face 34 of the first projecting portion 33. The second projection 35 is provided to support an outwardly projecting lip on the upright frame member 7', but is optional. The apertures 12 in the corner fitting may be formed to comply with the industry standards or requirements.

Figure 6:
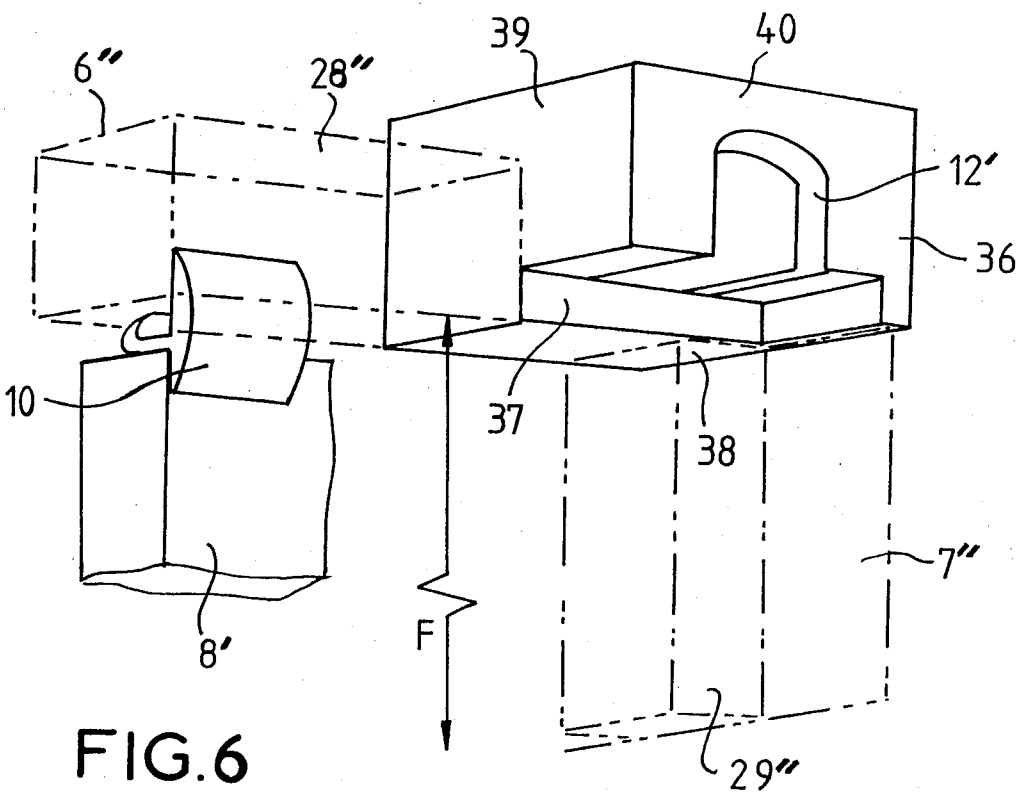
FIG. 6 is similar to FIG. 5 but shows another embodiment of a corner fitting in accordance with the invention.

FIG. 6 shows a modified version 36 of the corner fitting 32 of FIG. 5, in which a rebate is made in the corner fitting as before to form a surface 37 and planar surfaces 38, 39, but in which the aperture 12' has, as a result, no bottom. The positions of the frame members 6' and 7' are shown in dotted lines. A part of the door 8' and its seal 10 are shown. Dimension F indicates the height of the doorway. It can be seen that the seal 10 is provided with a continuous surface 28', 37 and 29'. Surface 37 may be curved to match the curvature of the seal 10, and the seal may extend upwardly beyond surface 37 and further into the fitting. The frame members 6', 7' may be connected directly to the corner fitting faces 39 , 38 without special cut-outs or projections, simplifying their manufacture and relieving the critical tolerances at their previous connection directly to each other. Comparisons of the door aperture height dimension F in FIG. 6 and the corresponding dimension E in FIG. 4 and of the relative heights of the horizontal frame members 6 and 6′ show that a greater door aperture has been achieved in the embodiment of FIG. 6. The requirement for an aperture is still satisfied since the purpose of the aperture is for crane hook lifting which acts only on the bridging piece 40.

Other arrangements of the corner fittings may be made, by, for example, inclining the surface 38 at an angle surface 39 or 36. Alternatively, the mating surfaces may be other than the plane surfaces 39, 38 in order to conform to the requirements of the member shapes and to assist with their easy and economic assembly, or to improve the dimensional features of the container.

The position of each of the corner fittings may be interchanged or selected according to need and thus a top fitting may be used in place of a bottom fitting if so desired. It is further invisaged that the recesses or the projections be selected according to the needs of adjacent frame members or members connected temporarily or permanently to them.

Figure 7:
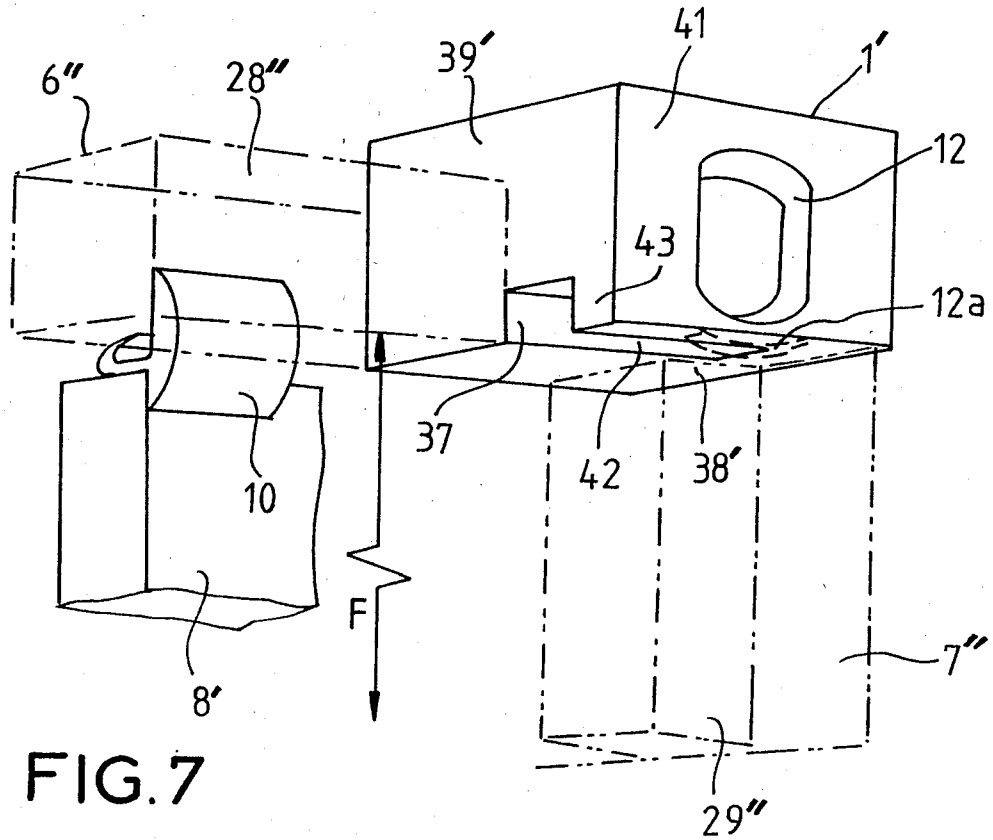
FIG. 7 is similar to FIGS. 5 and 6 but shows yet another embodiment of a corner fitting in accordance with the invention.

FIG. 7 shows how the ideas contained in FIG. 6 can be further developed. The full outer face 41 of the typical known corner fitting 1 has been retained in the modified fitting 1′ so that there is a full aperture 12 as before. This may be of use to handling devices which need the full aperture 12. A channel 42 is formed in the underside of the corner fitting 1′ in the plane surface 38. In some cases the top of the channel may open into the interior of the fitting; in other words the term "channel" is used to encompass a cut-out. There is formed a surface 37 which matches up with the surface 28′ of the horizontal frame member 6′. Thus the seal 10 attached to the door member 8′ has a continuous surface formed by surfaces 28′, 37′, 29′ with which to make contact and seal. When the door 8′ and seal 10 are opened away from the members 1, 6′ and 7′, the seal 10 may make contact with the projecting part 43 of the corner fitting 1. The seal 10 however is normally made of a flexible material similar to rubber so that on making contact with the projection 43, it merely wipes past it without damage to either. It may be desirable, in this and other embodiments, for the region of the fitting surrounding the holes 11, 12, 13 to be strengthened by the addition of extra metal. For example, in FIG. 7, the bottom of the hole may be thus strengthened as shown at 12*a* in phantom. The seal 10 may nevertheless wipe past when the door is opened or closed.

Figure 8:
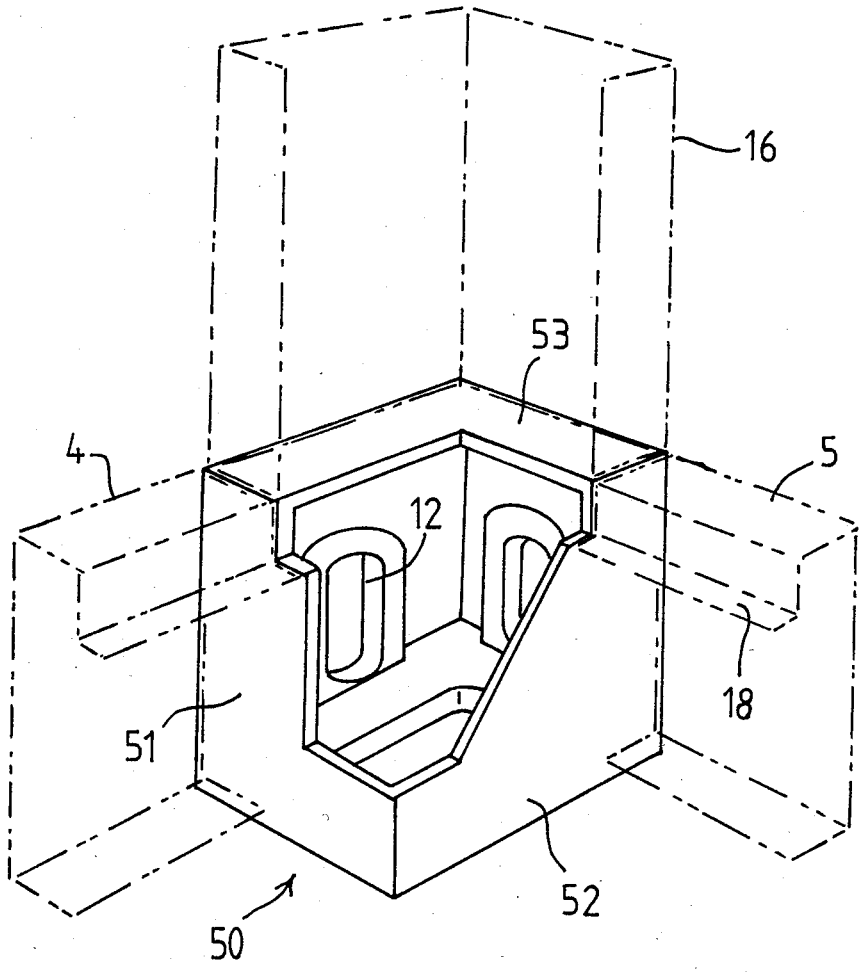
FIG. 8 is similar to FIG. 3 but shows another corner fitting in accordance with the invention.

FIG. 8 shows a further bottom corner fitting 50 in accordance with the invention which is similar to the fitting 20 shown in FIG. 3 but in which the three inside faces 51, 52, 53 are cut away about the notional innermost corner of the fitting. This arangement allows the weight of the fitting to be reduced and its manufacture to be easier. The floor timber 17 (not shown in FIG. 8) keeps rainwater and dirt out of the container.

Figure 9:
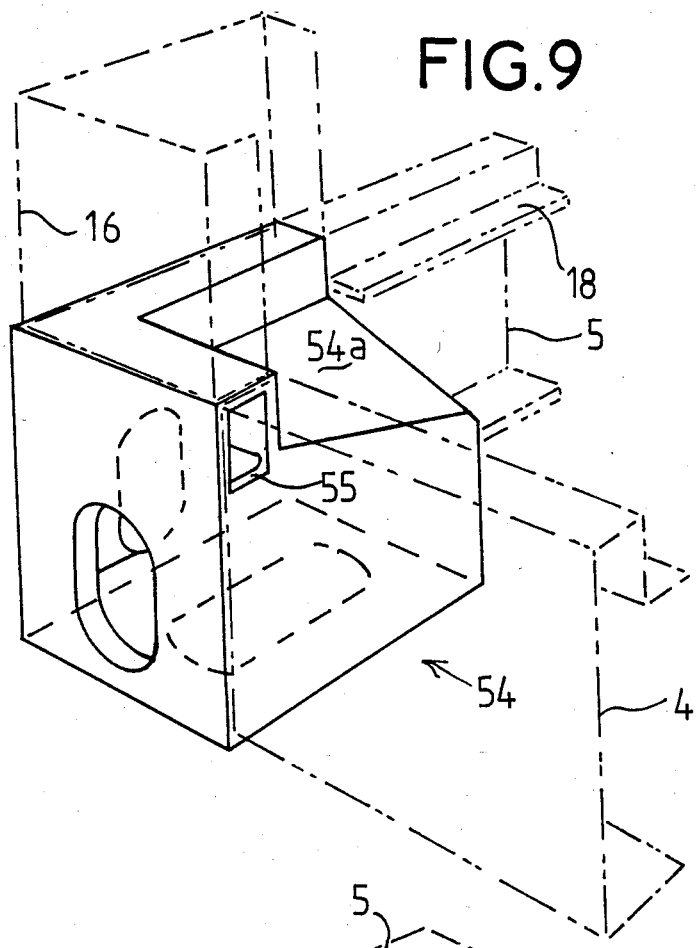
FIG. 9 is a perspective view of a further bottom corner fitting in accordance with the invention.

The fitting 54 in FIG. 9 does not provide a continuation of the lip 18 on the adjoining horizontal frame members, but is relatively easy to manufacture and the central sloping surface 54*a* allows rainwater to drain out and resists the nesting of bugs and the like. To reduce weight, an upper portion 55 of the fitting 54 is hollowed out.

Figure 10:
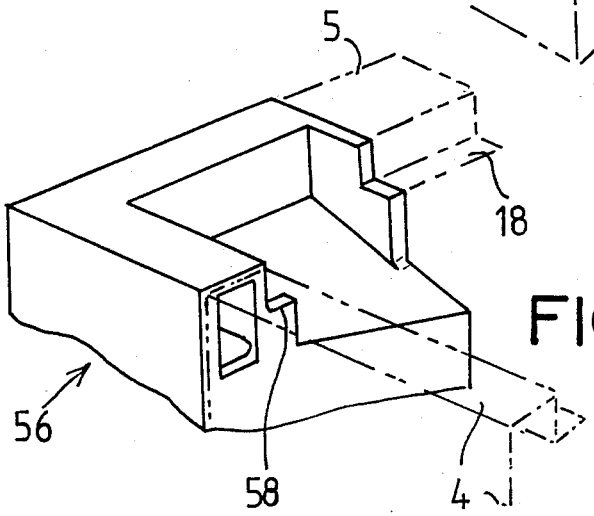
FIG. 10 corresponds to FIG. 9 but shows a slightly modified fitting in accordance with the invention.

FIG. 10 illustrates a fitting 56 which is identical to the fitting 54 of FIG. 9 but for the provision of an inwardly extending stepped web 57 and a smaller inwardly-extending non-stepped web 58. The webs 57, 58 act to continue the level of the lip 18 of the adjoining frame member 5 or 4, and certain of the dimensions of each web 5 or 4 are therefore chosen to match the relevant dimensions of the frame members 57 or 58.

Figure 11:
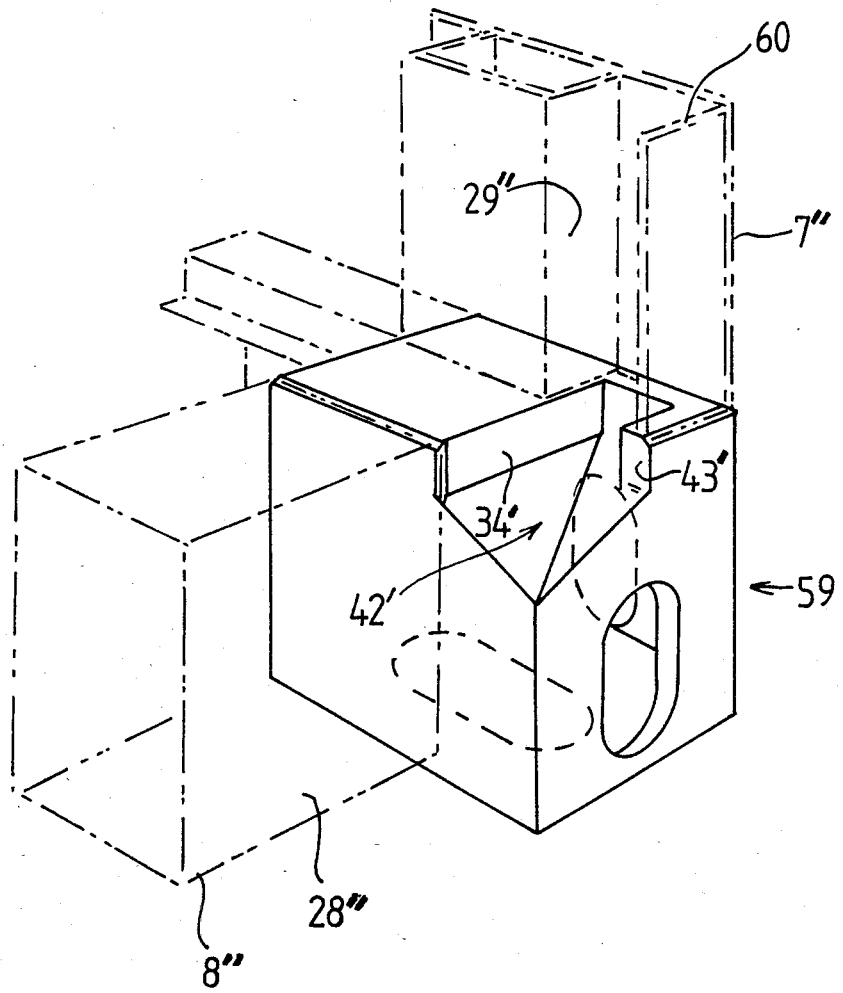
FIG. 11 is a perspective view of a door end bottom corner fitting in accordance with the invention.

The fitting 59 shown in FIG. 11 is a fitting for use at the door end of a container (illustrated in use at the bottom) having a modified upright frame member 7″ provided with a flange 60 extending parallel to the doors from the outer edge of the frame member 7″. This flange 60 serves to protect the door hinges (not shown) and the like. The fitting 59 is similar to the fitting 1′ of FIG. 7, but the portion 43′ defining the outer extent of the channel 42′ is only as long as the flange 60. Note that a continuous surface 29″, 34′, 28″ is still provided for the seal 10 (not shown in FIG. 11).

Figure 12:
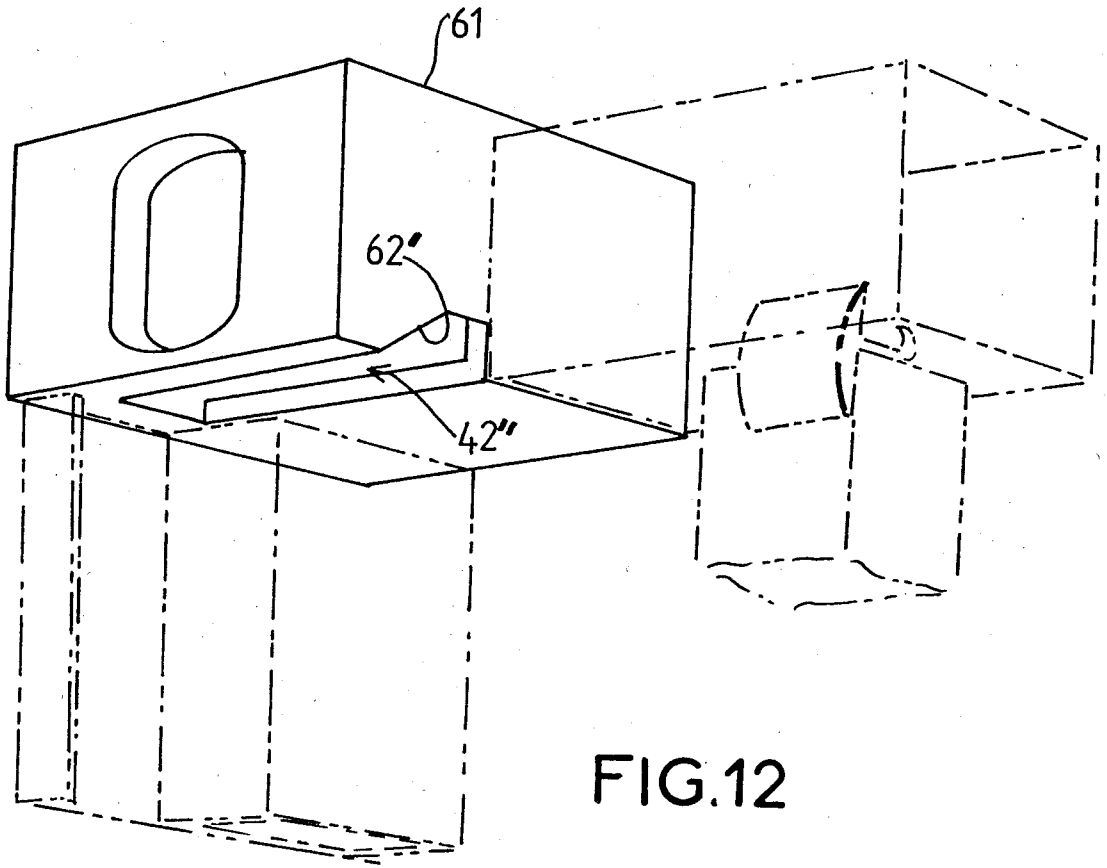
FIG. 12 is a perspective view of a door end top corner fitting in accordance with the invention.

The fitting 61 in FIG. 12 is a door end fitting (shown in use at the top) similar to the fittings of FIGS. 7 and 11, the main difference being that the outer long surface 62′ of the channel 42″ is inclined to the vertical. This has been found to aid the wiping action of the seal 10 when the doors are opened and closed.

Figure 13A:
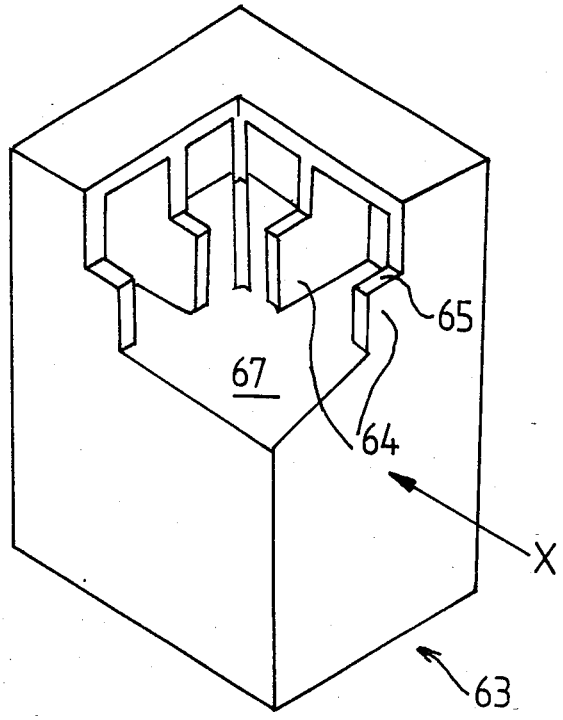
FIGS. 13A to 13D are differing views of a bottom corner fitting in accordance with the invention, FIG. 13A being a perspective view, 13B being an elevation taken along arrow X in FIG. 13A, 13C being a sectional view along arrows 13C—13C in FIG. 13B, and 13D being a section along plane 13D—13D in FIG. 13B.
Figure 13B:
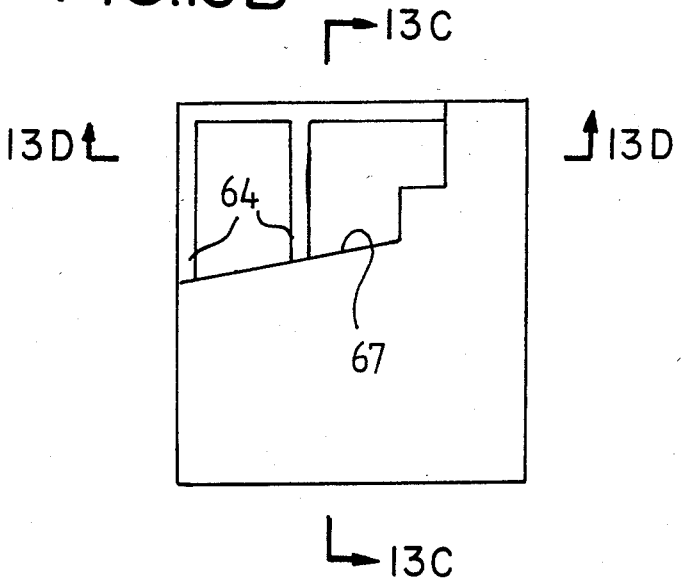
Figure 13C:
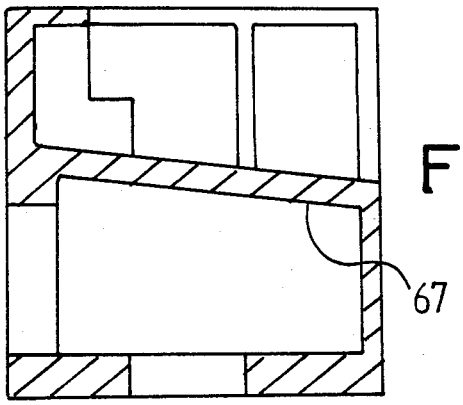
Figure 13D:
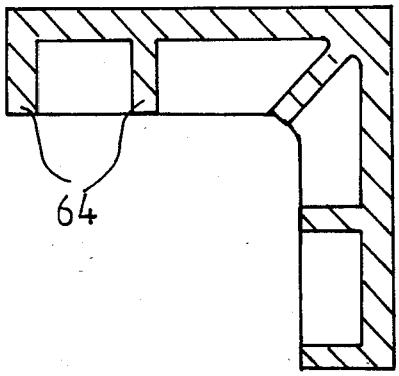

FIGS. 13*a*, 13*b*, 13*c* and 13*d* are differing views of a front end lower fitting 63. FIG. 13*a* is a perspective view of the fitting 63, and may be compared with FIG. 3. The frame members 4, 5 and 16 have been omitted for greater clarity. Whereas, in the fitting 20 of FIG. 3, the level of the inwardly-extending lips 18 on the two horizontal frame members 4, 5 was continued by a continuous step 22 in order to provide a support for the floor member 17, in the fitting 63 of FIG. 13*a*, this continuation of the lips 18 is provided by a plurality of stepped webs 64, a respective pair of the webs 64 extending inwardly parallel to the side and end of the container and the fifth web 64 extending diagonally inwardly from the outer corner of the fitting 63. FIG. 13*d*, which is a section taken on plane B—B in FIG. 13*b*, illustrates more clearly this arrangement of the webs 64. The location of the step 65 of each stepped web 64 is chosen by reference to the thickness of the floor timber 17 (not illustrated) so that the top of the floor member 17 is flush with the flat top 66 of the fitting 63. The bottom of each web 64 merges into a downwardly-sloping intermediate portion 67 of the fitting 63, this intermediate portion being best illustrated in FIG. 13*c* (which is a sectional view taken along A—A in FIG. 13*b*) and FIG. 13*b*. The holes 12 used to engage handling and storage equipment are clearly visible in FIG. 13*c*. It has been found that the fitting 63 illustrated in FIGS. 13*a* to 13*d* is sturdy without being excessively heavy.

Figure 14:
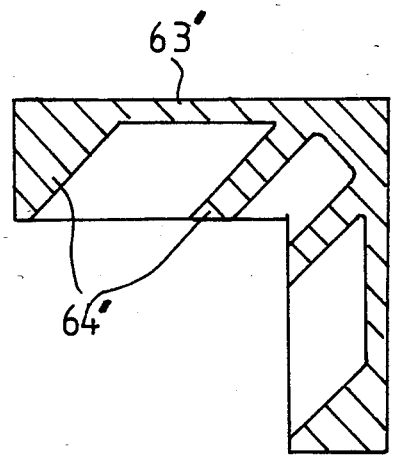
FIG. 14 corresponds to FIG. 13D but shows a modified configuration in accordance with the invention.

FIG. 14 corresponds to FIG. 13*d* but shows an alternative pattern of webs 64′ used in a modified fitting 63′. A greater mass of material is used to form the modified fitting 63′ of FIG. 14, but the manufacture of the fitting may be easier.

Figure 15:
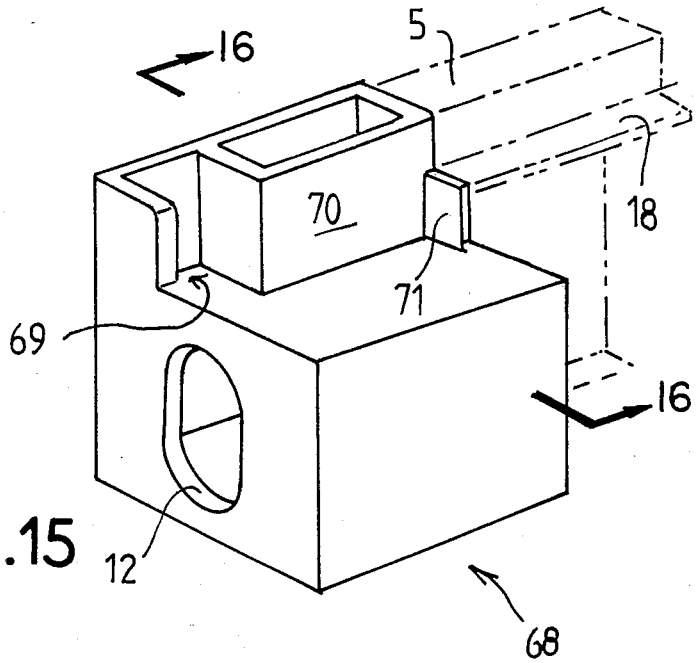
FIG. 15 is a perspective view of a door end bottom corner fitting in accordance with the invention.
Figure 16:
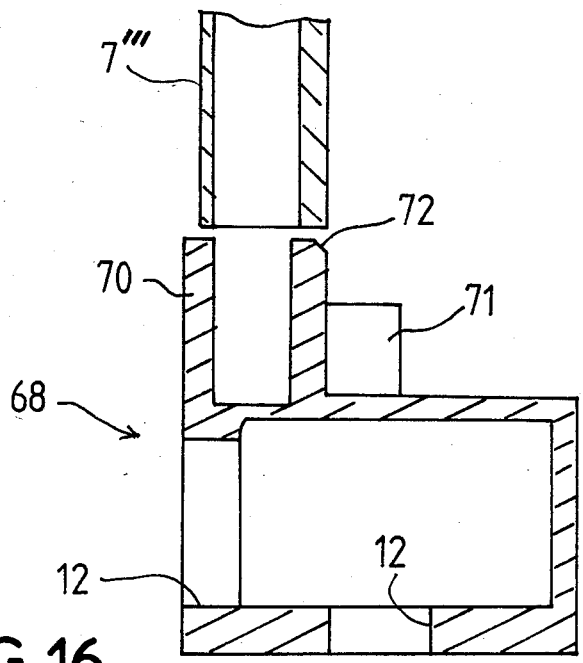
FIG. 16 is a vertical sectional view of the fitting of FIG. 15, taken along arrows 16—16 and showing part of a vertical frame member not shown in FIG. 15.

Finally, FIGS. 15 and 16 illustrate yet another fitting 68 which may be regarded as combining some of the features of the respective fittings illustrated in FIGS. 10 and 11. The fitting 68 in FIG. 15 and 16 is a bottom fitting for use at the door end of the container with an upright frame member 7′ having a flange 60′ similar to the flange shown in phantom in FIG. 11. A short channel 69 is created, corresponding to the channel 42′ in FIG. 11. However, instead of the box portion of the upright frame member 7′ being supported on a planar top surface of the fitting (as in FIG. 11), the said box portion is supported by a hollowed-bolt portion 70 of the fitting 68. An inwardly-extending web 71 is provided adjacent the said portion 70 of the fitting, corresponding with the web 58 illustrated in FIG. 10, to provide continued support for the floor member 17 (not illustrated in FIG. 15) by continuing the level of the lip 18 on the adjoining frame member. FIG. 16 illustrates the way in which an edge 72 of the fitting can be prepared to aid welding of the fitting to an adjoining frame member.

Figure 17:
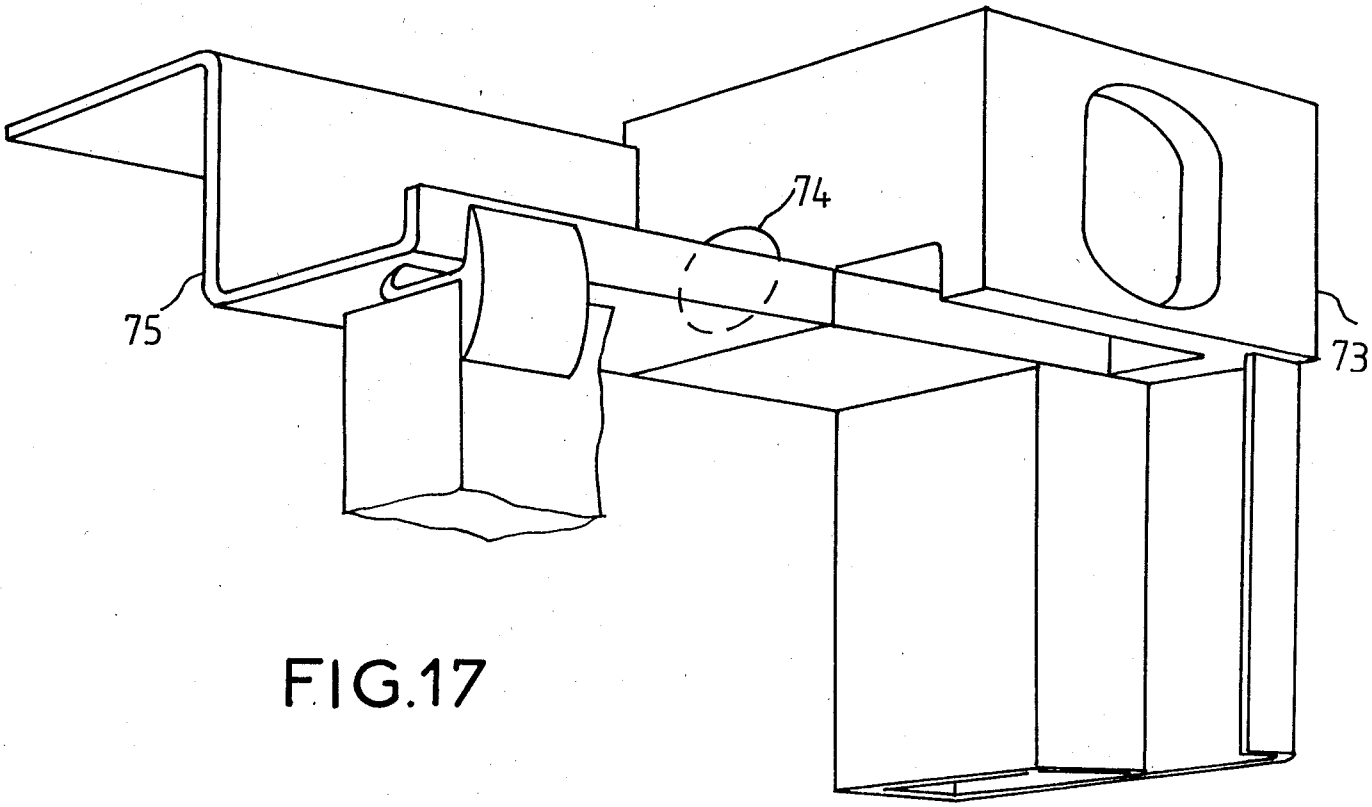
FIG. 17 is a perspective view of a top door end corner fitting in accordance with the invention.

FIG. 17 shows a corner fitting 73 having a drain hole 74 to allow rainwater to leave the fitting. Note the open section horizontal frame member 75.

Figure 18:
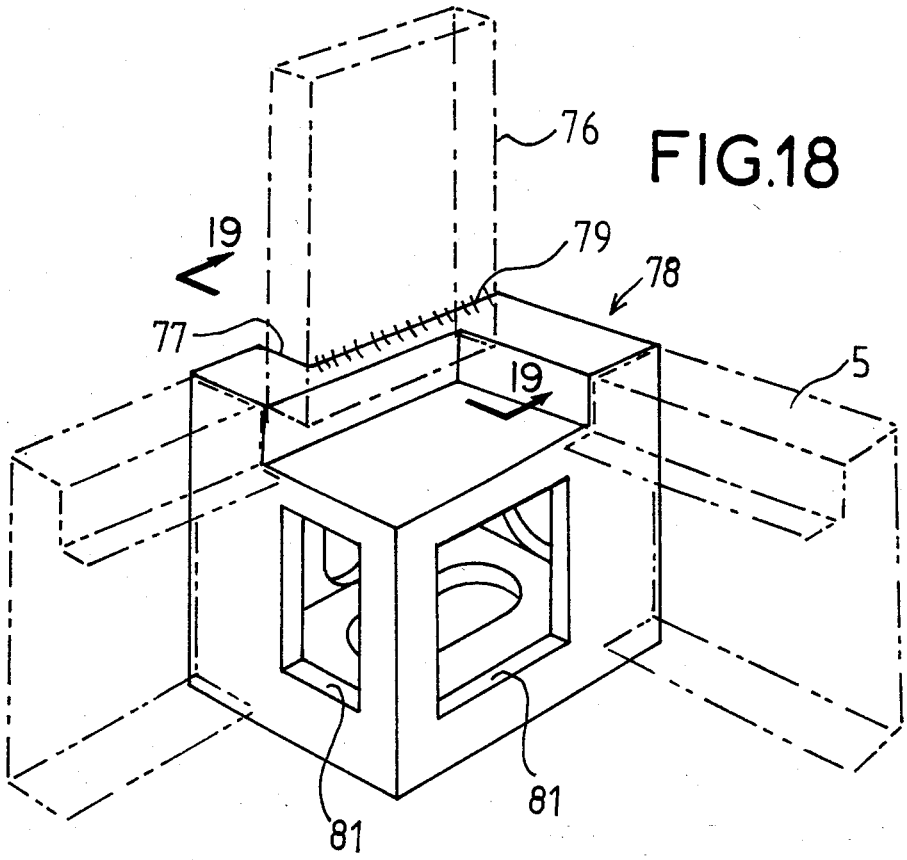
FIG. 18 is a perspective view of a bottom corner fitting in accordance with the invention.
Figure 19:
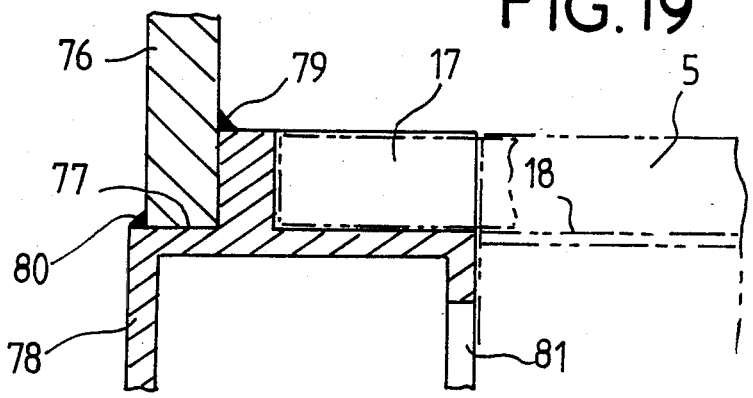
FIG. 19 is a section along P—P in FIG. 19.

In the embodiment of FIGS. 18 and 19 the upright frame member 76 is accommodated within a small well 77 in the top face of the corner fitting 78, to allow the welding (e.g. at 79 and 80) to be stronger, and holes 81 are cut or otherwise formed in the inside vertical faces of the fitting to reduce weight.

Figure 20:
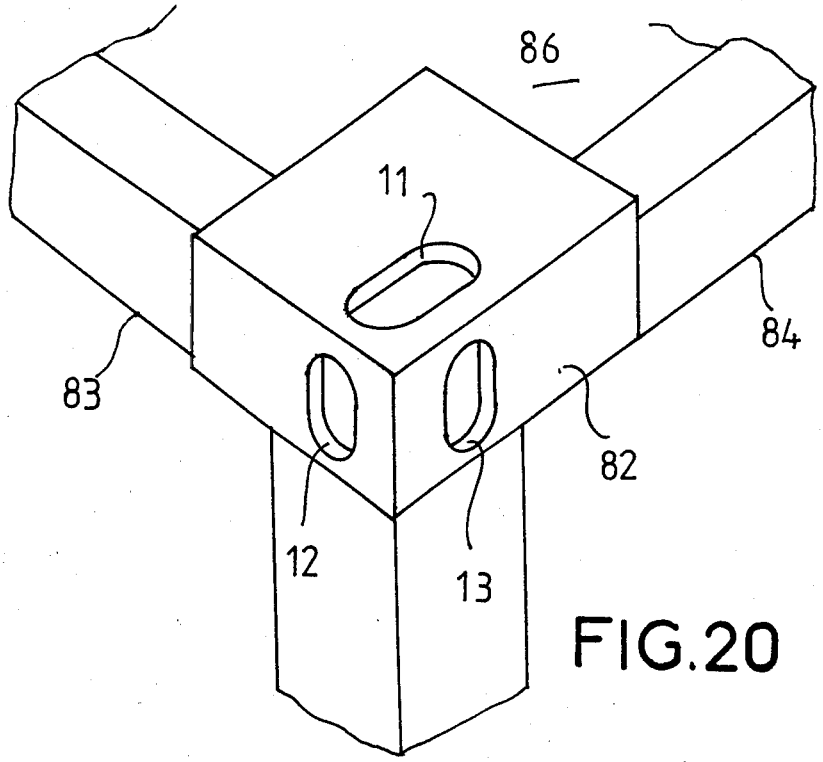
FIG. 20 is a perspective view of a top corner fitting in accordance with the invention.
Figure 21:
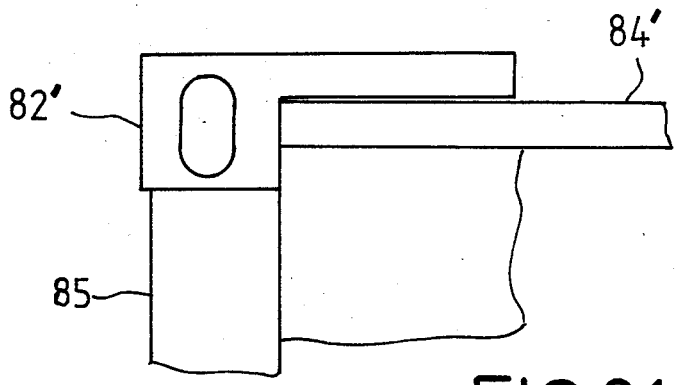
FIG. 21 is a side elevation of a top corner fitting in accordance with the invention.

In all of the embodiments described above, the load-bearing face or faces of the corner fitting may be extended, with concomitant shortening of the relevant frame members, as is illustrated in general in FIG. 20. FIG 21 shows an alternative. In this way, a greater proportion of the load (for example the weight of a second container being stacked on top) will be supported by the (relatively strong) corner fitting 82 or 82' instead of on the (relatively weak) frame members 83, 84 or 85, 84' or panel 86. In addition, or instead, the said face of the fitting can be so profiled as to guide the conical engaging elements commonly used in container storage and lifting machinery into place correctly. For example grooves, ridges and/or pockets may be provided, in order to minimise the damage which is often caused, by mis-handling of the equipment, around the corner fittings.

In all of the embodiments of the corner fittings described above, the method of manufacturing the fitting and the material used for the fitting may be standard. For example, the fitting may be cast from ordinary steel, stainless steel or an aluminium alloy. The corner member need not be an actual casting, but may be made by a hot forging process or by fabrication (using rivets or welding or both) from plate components or by a combination of two or more of these processes.

What is claimed is:

1. A cuboid container, said container comprising:

frame members of elongate configuration with elongate surfaces defined thereon, the frame members being located to form a frame which defines edges of the container:

a plurality of cuboid corner members located at the junctions of the frame members and interconnecting the frame members, (i) each corner member having three outwardly facing faces, and three inwardly facing faces, (ii) at least some of the corner members having respective portions of at least one of the three inwardly facing faces absent in the region of the innermost corner of said corner members to define a recess therein, said recess bounded by edges of the three inwardly facing faces of said corner members, (iii) an inner surface on each of two perpendicularly oriented frame members interconnected by said corner members with said recess, said inner surface being aligned with a corresponding surface on the corner member, said corresponding surface defined by said recess, the aligned surfaces continuing to form a corner, and (iv) substantially all of each end of each frame member being within the periphery of, abutting and being secured to a respective face of a corner member such that no portion of the corner member extends past said end of each frame member, and means defining faces of the container.

2. A container according to claim 1 wherein each end of each frame member lies in a respective plane which is substantially perpendicular to the length of the said member.

3. A container according to claim 1 or claim 2 wherein the said face of the corner member is in each case planar.

4. A container according to claim 1 wherein the frame members which define the bottom edges of the container are each provided with an inwardly-extending lip for supporting a floor member, said lip comprising said inner surface.

5. A container according to claim 4 wherein said corresponding surface on the corner member comprises a substantially continuous step.

6. A container according to claim 4 wherein said corresponding surface on the corner member comprises a plurality of inwardly extending webs, the plane of each web being substantially vertical.

7. A container according to claim 6 wherein at least some of the said webs are stepped.

8. A container according to claim 1 wherein at least one door is provided in at least one face of the container and the corner members adjoining said container face are each provided with a respective surface substantially co-planar with respective surfaces of the two frame members which meet at said corner member and define two edges of said face of the container, the arrangement being such that said surfaces cooperate with one another to provide a substantially continuous support surface or edge for a sealing means surrounding at least part of said door.

9. A container according to claim 8 wherein said co-planar surface on each of said corner members adjacent said door forms one bounding surface of a channel provided within said corner member, the channel being adapted to accommodate part of said sealing means.

10. A container according to claim 9 wherein the bounding co-planar surface of the said channel opposite the said surface on the corner member is planar and inclined to the vertical.

11. A container according to claim 8 wherein said co-planar surface on each of said corner members adjacent said door is constituted by an outwardly-facing surface of said corner member.

12. A container according to claim 1 wherein four cuboid corner members are provided at respective bottom corners of the container and the corner member periphery defining said recess supports a floor member of the container.

* * * * *